US009312062B2

(12) United States Patent
Kato

(10) Patent No.: US 9,312,062 B2
(45) Date of Patent: Apr. 12, 2016

(54) COMMON MODE CHOKE COIL

(71) Applicant: Murata Manufacturing Co., Ltd., Nagaokakyo-shi, Kyoto-fu (JP)

(72) Inventor: Noboru Kato, Nagaokakyo (JP)

(73) Assignee: Murata Manufacturing Co., Ltd., Kyoto (JP)

( * ) Notice: Subject to any disclaimer, the term of this patent is extended or adjusted under 35 U.S.C. 154(b) by 0 days.

(21) Appl. No.: 14/469,760

(22) Filed: Aug. 27, 2014

(65) Prior Publication Data

US 2014/0368307 A1 Dec. 18, 2014

Related U.S. Application Data

(63) Continuation of application No. PCT/JP2013/054257, filed on Feb. 21, 2013.

(30) Foreign Application Priority Data

Mar. 16, 2012 (JP) ..... 2012-060281
Dec. 19, 2012 (JP) ..... 2012-276465

(51) Int. Cl.
*H01F 5/00* (2006.01)
*H01F 27/24* (2006.01)
(Continued)

(52) U.S. Cl.
CPC ..... *H01F 27/2804* (2013.01); *H01F 17/0013* (2013.01); *H01F 27/343* (2013.01); *H01F 2017/004* (2013.01); *H01F 2017/008* (2013.01);
(Continued)

(58) Field of Classification Search
CPC ..... H01F 27/2804; H01F 27/343; H01F 2017/0093; H01F 2027/2809; H01F 17/0013
USPC ..... 336/200, 234
See application file for complete search history.

(56) References Cited

U.S. PATENT DOCUMENTS 6,577,219 B2 * 6/2003 Visser ..... 336/200
2003/0134612 A1 * 7/2003 Nakayama et al. ..... 455/307
(Continued)

FOREIGN PATENT DOCUMENTS

JP 2000-277354 A 10/2000
JP 2003-068528 A 3/2003
(Continued)

OTHER PUBLICATIONS

Official Communication issued in International Patent Application No. PCT/JP2013/054257, mailed on May 28, 2013.
(Continued)

*Primary Examiner* — Mangtin Lian
(74) *Attorney, Agent, or Firm* — Keating & Bennett, LLP

(57) ABSTRACT

In a common mode choke coil, electrodes of input/output terminals are located on a bottom surface of a bottom layer. First linear conductors and second linear conductors are located on base material layers. A primary coil includes the first linear conductors and via hole conductors. A secondary coil includes the second linear conductors and via hole conductors. In a plan view as seen from a direction of winding axes of the primary coil and the secondary coil, as for a plurality of first linear conductors and second linear conductors which are adjacent in a plan direction, there are provided a first region in which the second linear conductors are located between the first linear conductors, and a second region in which the first conductors are located between the second linear conductors.

12 Claims, 18 Drawing Sheets

(51) Int. Cl.
*H01F 27/28* (2006.01)
*H01F 17/00* (2006.01)
*H01F 27/34* (2006.01)

(52) U.S. Cl.
CPC . *H01F 2017/0093* (2013.01); *H01F 2027/2809* (2013.01)

(56) References Cited

U.S. PATENT DOCUMENTS

| | | | | |
|---|---|---|---|---|
| 2012/0211864 | A1* | 8/2012 | Tanabe | 257/531 |
| 2013/0249661 | A1* | 9/2013 | Motomiya et al. | 336/200 |
| 2014/0232501 | A1 | 8/2014 | Kato | |

FOREIGN PATENT DOCUMENTS

| | | | |
|---|---|---|---|
| JP | 2003-124027 | A | 4/2003 |
| JP | 2004-095860 | A | 3/2004 |
| JP | 2004-311829 | A | 11/2004 |
| JP | 2005-294486 | A | 10/2005 |
| JP | 2007-103477 | A | 4/2007 |
| JP | 2008-098625 | A | 4/2008 |
| JP | 2008-118059 | A | 5/2008 |
| JP | 2010-028695 | A | 2/2010 |
| JP | 2012-169410 | A | 9/2012 |
| WO | 01/67470 | A1 | 9/2001 |
| WO | 2011/114859 | A1 | 9/2011 |
| WO | 2013/065716 | A1 | 5/2013 |

OTHER PUBLICATIONS

Official Communication issued in corresponding Japanese Patent Application No. 2014-504754, mailed on Jun. 10, 2014.

* cited by examiner

COMMON MODE CHOKE COIL

BACKGROUND OF THE INVENTION

1. Field of the Invention

The present invention relates to a common mode choke coil preferably for use in a transmission line for a high frequency signal.

2. Description of the Related Art

In high-speed interfaces such as a USB (Universal Serial Bus) and an HDMI (High Definition Multimedia Interface), there has been used a "differential transmission system" in which signals whose phases are 180° different from each other are transmitted on a pair of signal lines (=parallel lines). In the differential transmission system, radiation noise and external noise are cancelled on the parallel lines, and hence these noises are not apt to exert an influence. However, in reality, especially on signal lines for the high-speed interface, a common mode noise current ascribed to the asymmetry of the signal lines is generated. A common mode choke coil is thus used for the purpose of suppressing this common mode noise.

As disclosed in FIGS. 1A and 1B of Unexamined Japanese Patent Publication No. 2003-068528, FIGS. 2A and 2B of Unexamined Japanese Patent Publication No. 2008-098625 and the like, the common mode choke coil is typically configured as a small-sized laminated chip component provided with two coils (primary coil, secondary coil) wound in the same direction. Here, the primary coil and the secondary coil are arrayed in a laminating direction inside a laminated element body.

FIG. 18 is a sectional view of the common mode choke coil shown in Unexamined Japanese Patent Publication No. 2003-068528. This common mode choke coil has a structure provided with two coils (laminated coils) 2, 3 which are coaxially wound and axially disposed separately in a laminated element 1, and a leader and a trailer of each of the coils 2, 3 are extracted to the end surface of each side of the laminated element 1 and connected to an external electrode.

However, a coupling degree between the primary coil and the secondary coil is difficult to make high just by simply arraying the primary coil and the secondary coil in the laminating direction inside the laminated element body. When the coupling degree between the primary coil and the secondary coil is low, an insertion loss of a normal mode signal increases. On the other hand, when the primary coil and the secondary coil are arranged close to each other so as to make the coupling degree high, a capacitance (stray capacitance) generated between the primary coil and the secondary coil increases. When this capacitance increases, differential impedance of the common mode choke coil decreases, and becomes unable to be matched with impedance of the balanced transmission line.

Further, in the structure where the primary coil and the secondary coil are arrayed in the laminating direction inside the laminated element body, there occurs displacement of a formed position of a coil pattern or displacement of lamination of sheets due to a process problem. Moreover, when the coils are mounted on a printed wiring board, a capacitance between the primary coil and a ground conductor and a capacitance between the secondary coil and the ground conductor becomes unbalanced due to a structural problem such as a difference in coupling amount between each coil and the ground conductor. For this reason, the symmetry between the primary coil and the secondary coil cannot be ensured, leading to conversion of the common mode noise to the normal mode signal (noise). That is, the ability to remove the common mode noise is degraded.

Further, although a magnetic body may be used as the laminated element body, since the magnetic body has relatively large frequency dependence, a loss of the normal mode signal especially in a high frequency band is apt to become large. Moreover, a sufficient coupling value between the primary coil and the secondary coil cannot be obtained especially in the high frequency band, and the loss of the normal mode signal is apt to become large.

SUMMARY OF THE INVENTION

Preferred embodiments of the present invention provide a small-sized common mode choke coil having a small loss of a normal mode signal and a high ability to remove common mode noise.

A common mode choke coil according to a preferred embodiment of the present invention is a common mode choke coil including a primary coil including a plurality of first linear conductors that are spirally wound and connected, and a secondary coil a plurality of second linear conductors that are spirally wound and connected and magnetically coupled to the primary coil, the common mode choke coil including, in a plan view from a direction of winding axes of the primary coil and the secondary coil: a first region in which the second linear conductors are located between the first linear conductors; and a second region in which the first linear conductors are located between the second linear conductors, wherein, in the first region and the second region, the first linear conductor and the second linear conductor are not superimposed as seen in the plan view from the direction of the winding axes of the primary coil and the secondary coil.

According to various preferred embodiments of the present invention, it is possible to achieve magnetic field coupling between the primary coil and the secondary coil with a high coupling degree without increasing capacitive coupling between the primary coil and the secondary coil. Hence, it is possible to obtain a small-sized common mode choke coil in which differential impedance is not apt to decrease regardless of a small insertion loss of a normal mode signal.

The above and other elements, features, steps, characteristics and advantages of the present invention will become more apparent from the following detailed description of the preferred embodiments with reference to the attached drawings.

DETAILED DESCRIPTION OF THE PREFERRED EMBODIMENTS

Each of preferred embodiments of the present invention will be described sequentially referring to each of the diagrams.

First Preferred Embodiment

Figure 1A:
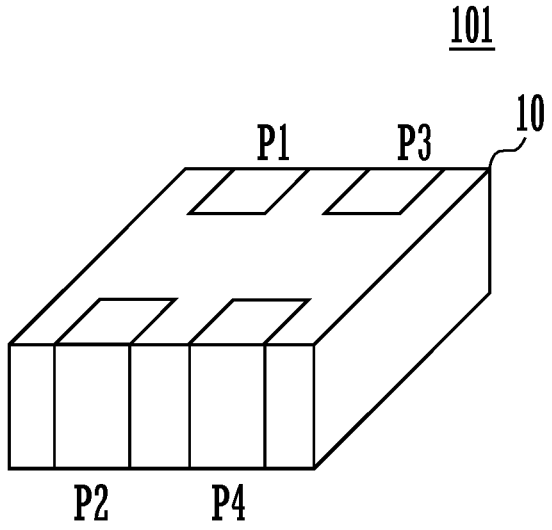
FIG. 1A is an external perspective view of a common mode choke coil 101 of a first preferred embodiment of the present invention.
Figure 1B:
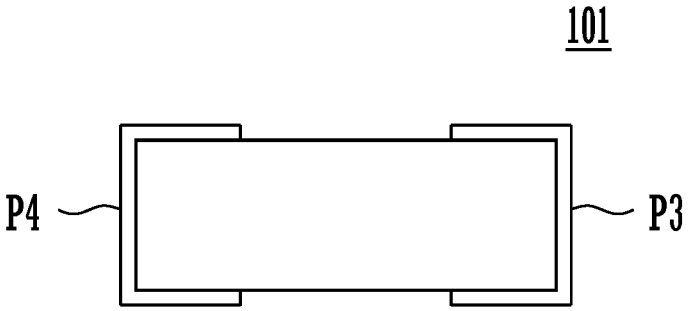
FIG. 1B is a side view of a common mode choke coil 101 of the first preferred embodiment of the present invention.

FIG. 1A is an external perspective view of a common mode choke coil 101 of a first preferred embodiment of the present invention, and FIG. 1B is a side view thereof.

As shown in FIGS. 1A and 1B, input/output terminals P1, P2, P3, P4 are provided on an external surface of a laminated element body 10.

In the case of a common mode choke coil for an HF (High Frequency) band, an eddy current loss is relatively small, and hence a magnetic material (dielectric material with a high magnetic permeability) can be used as a material for a base material layer in terms of containment properties of magnetic energy. As this magnetic material, a ferrite magnetic body adaptable to a high frequency, such as hexagonal ferrite, may be used. On the other hand, for example, in the case of forming a common mode choke coil for a UHF (Ultra High Frequency) band, it is preferable to use a dielectric material with high electric insulation resistance so as to suppress an eddy current loss in a high-frequency band. Since the magnetic body represented by ferrite has frequency dependence in terms of its magnetic permeability, when the base material layer is the magnetic body, a loss becomes larger as a used frequency band becomes higher. As opposed to this, since the dielectric body has a relatively small frequency dependence, when the base material layer is the dielectric body, it is possible to realize a laminated common mode choke coil with a small loss in a broad frequency band. That is, as for a common mode choke coil for use in a high-speed interface including the broad band, especially the high frequency band, it is preferable to use a dielectric layer being a non-magnetic body layer as the base material layer.

The base material layer may be a dielectric ceramic layer such as LTCC (Low Temperature Co-fired Ceramics), or a resin layer made of a thermoplastics resin or a thermosetting resin. That is, the laminated element body may be a ceramic laminated body, or may be a resin laminated body. Further, a linear conductor, an interlayer connection conductor, a surface conductor provided on the surface of the laminated element body and the like which constitute each coil are preferably metal materials mainly composed of a metal with a small specific resistance, such as copper or silver.

Figure 2A:
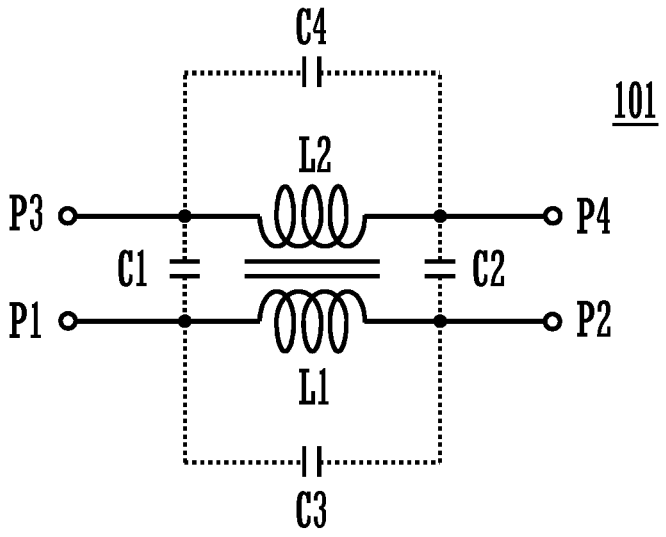
FIGS. 2A and 2B are equivalent circuit diagrams of the common mode choke coil 101.
Figure 2B:
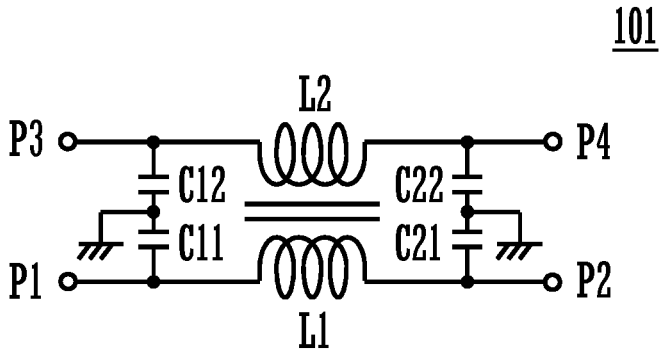

FIG. 2A is an equivalent circuit diagram of the common mode choke coil 101. As later described in detail, flowing of a common mode current brings about strong magnetic field coupling between a primary coil L1 and a secondary coil L2. A stray capacitance is generated between the primary coil L1 and the secondary coil L2. In FIGS. 2A and 2B, this stray capacitance is represented by each of capacitors C1, C2 as a lumped parameter circuit. A stray capacitance is also generated between lines of the primary coil L1 and between lines of the secondary coil L2. In FIGS. 2A and 2B, this stray capacitance is represented by each of capacitors C3, C4 as a lumped parameter circuit.

When the line capacitances (C3, C4) are generated in the primary coil (L1) and the secondary coil (L2), self-resonance may occur in a passage band. Therefore, the line capacitance in each coil is preferably made as small as possible. While the capacitance (C1, C2) between the primary coil (L1) and the secondary coil (L2) is necessary for adjustment of differential impedance, when this capacitance becomes extremely large, the differential impedance decreases.

The equivalent circuit of the common mode choke coil 101 is also represented as in FIG. 2B. In FIG. 2B, the stray capacitance is represented by C11, C12, C21, C22.

Figure 3:
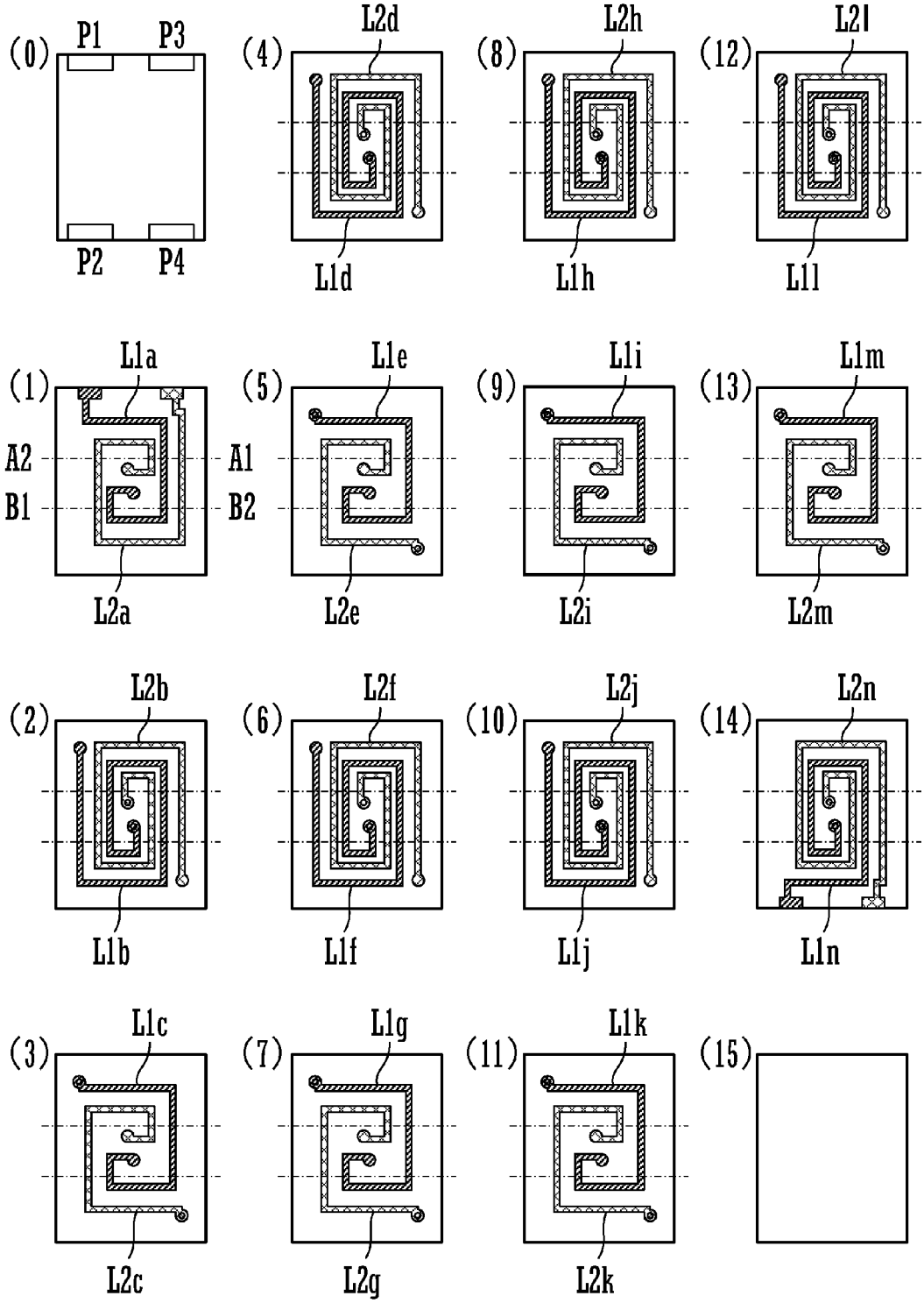
FIG. 3 is an exploded plan view showing a conductor pattern and the like of each base material layer in the common mode choke coil of the first preferred embodiment of the present invention.

FIG. 3 is an exploded plan view showing a conductor pattern and the like of each base material layer in the common mode choke coil of the first preferred embodiment. In FIG. 3, (0) is a bottom view of a bottom layer, (1) is a top view of the bottom layer, and (15) is a top view of a top layer. Electrodes of input/output terminals P1 to P4 are located on the bottom surface of the bottom layer (0). On base material layers shown in (1) to (14), first linear conductors L1*a* to L1*n* and second linear conductors L2*a* to L2*n* are provided.

A circular pattern in FIG. 3 is a connection section (pad section) of a via hole conductor. A double-circular pattern is the via hole conductor (interlayer conductor). With this structure, the linear conductor and the linear conductor which are adjacent in a layer direction are connected between the layers.

The primary coil includes the first linear conductors L1*a* to L1*n* and the via hole conductors connecting those. Further, the secondary coil includes the second linear conductors L2*a* to L2*n* and the via hole conductors connecting those.

In FIG. 3, the end of the first linear conductor L1*a* is connected to the input/output terminal P1, and the end of the first linear conductor L1*n* is connected to the input/output terminal P2. Further, the end of the second linear conductor L2*a* is connected to the input/output terminal P3, and the end of the second linear conductor L2*n* is connected to the input/output terminal P4.

Figure 4:
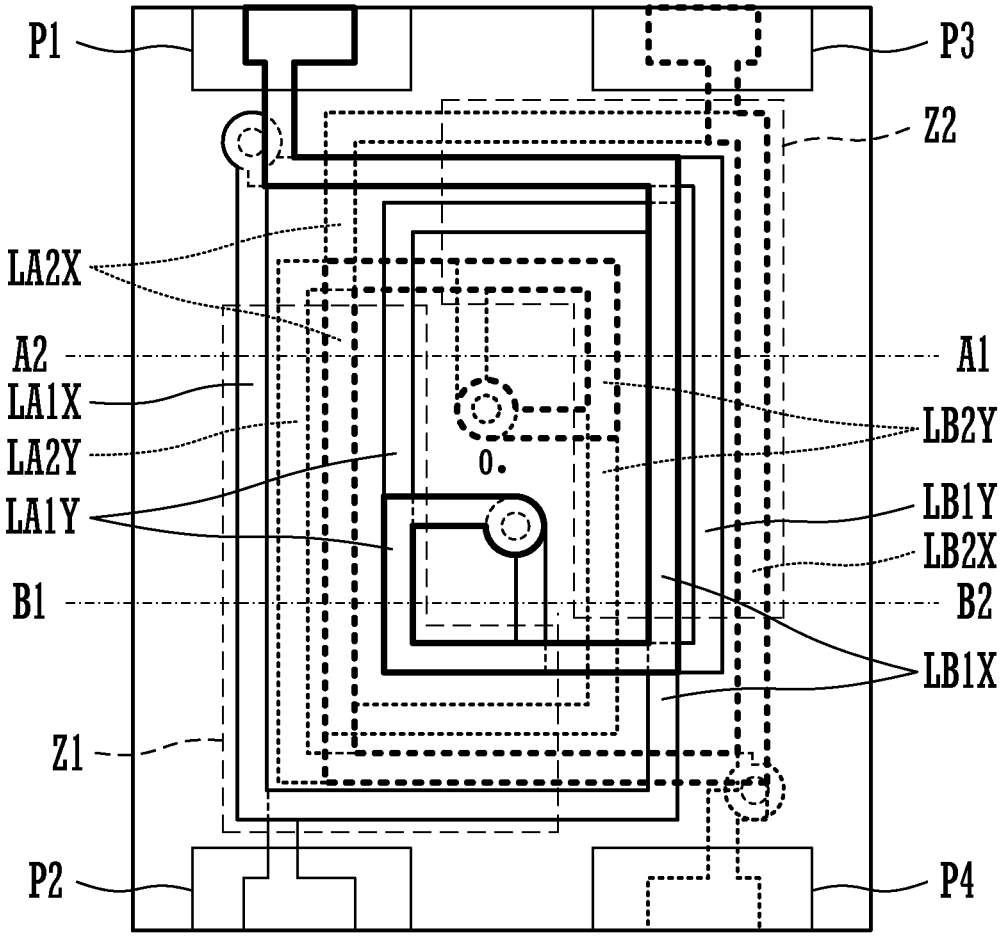
FIG. 4 is a plan perspective view of each conductor pattern of the common mode choke coil 101.
Figure 5:
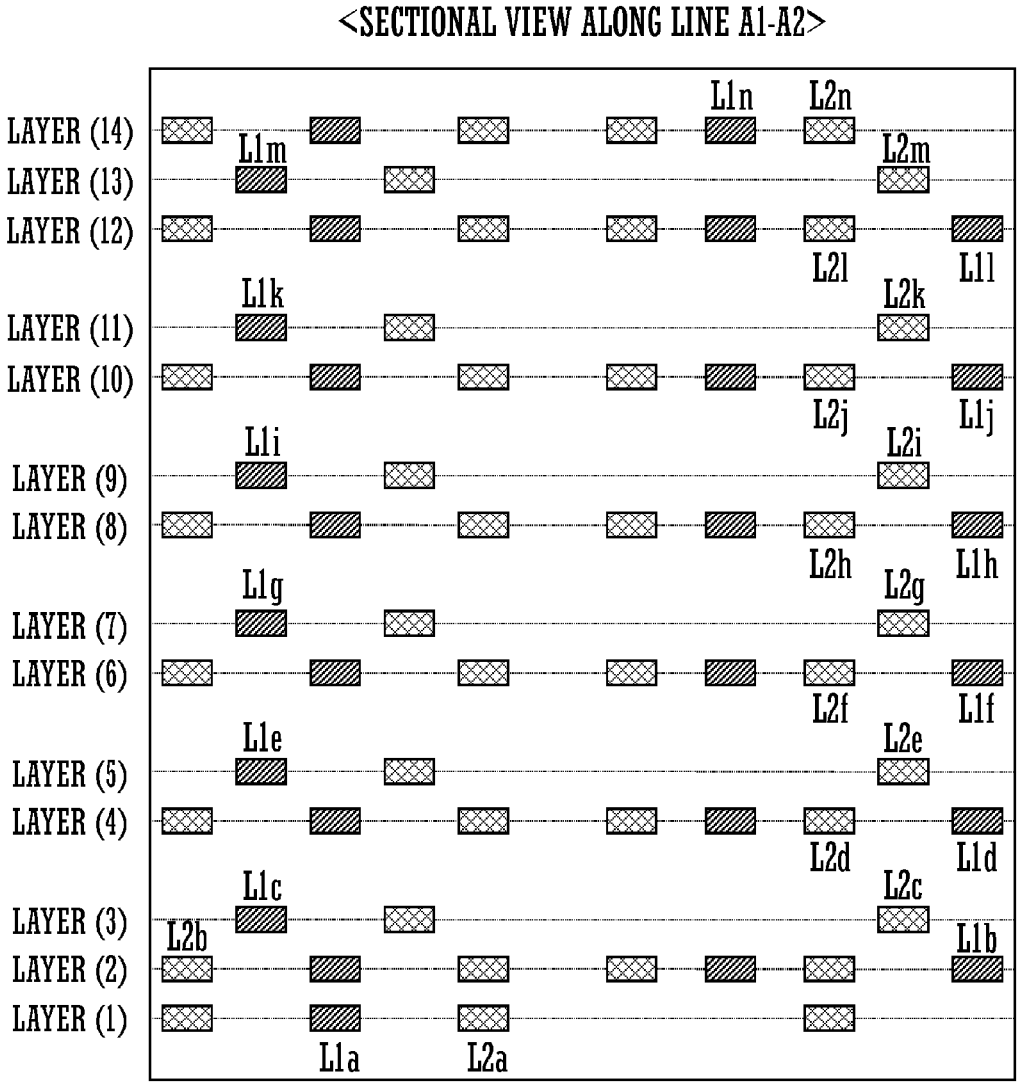
FIG. 5 is a sectional view along a line A1-A2 in FIGS. 3 and 4.
Figure 6:
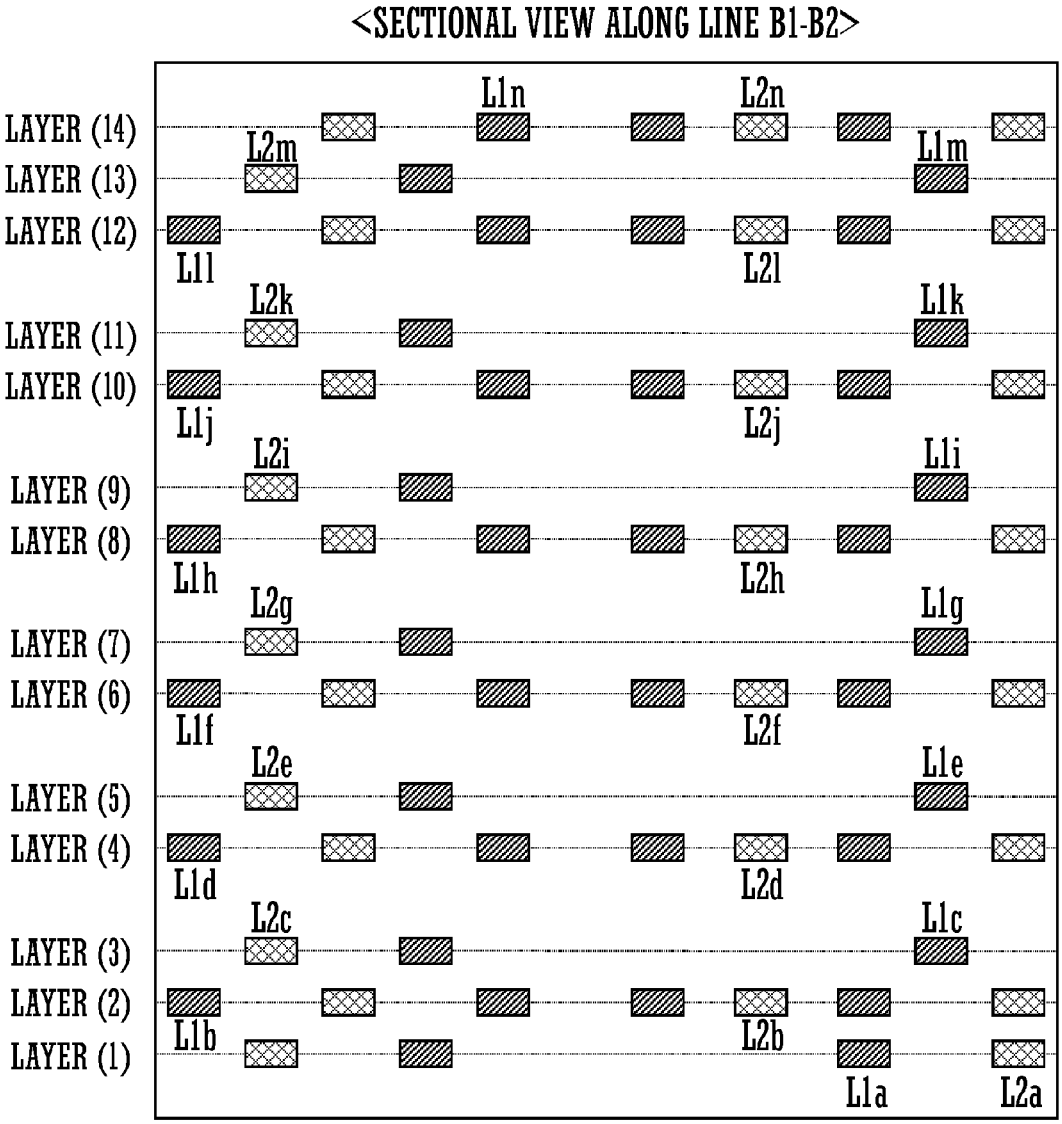
FIG. 6 is a sectional view along a line B1-B2 in FIGS. 3 and 4.

FIG. 4 is a plan perspective view of each conductor pattern of the common mode choke coil 101. Further, FIG. 5 is a sectional view along a line A1-A2 in FIG. 4, and FIG. 6 is a sectional view along a line B1-B2 in FIG. 4.

In FIG. 4, in a first region Z1, a conductor pattern is arranged such that second linear conductors LA2X, LA2Y are located between a first linear conductor LA1X and a first linear conductor LA1Y. In a second region Z2, a conductor pattern is arranged such that first linear conductors LB1X, LB1Y are located between a second linear conductor LB2X and a second linear conductor LB2Y.

The relation between each of the linear conductors LA1X, LA1Y, LB1X, LB1Y, LA2X, LA2Y, LB2X, LB2Y in FIG. 4 and each of the linear conductors shown in FIG. 3 is as follows.

LA1X: L1*b*, L1*d*, L1*f*, L1*h*, L1*j*, L1*l*

LA1Y: L1*a* to L1*n*

LB1X: L1*a*, L1*b*, L1*d*, L1*f*, L1*h*, L1*j*, L1*l*, L1*n*

LB1Y: L1*c*, L1*e*, L1*g*, L1*i*, L1*k*, L1*m*

LA2X (LB2X): L2*a*, L2*b*, L2*d*, L2*f*, L2*h*, L2*j*, L2*l*, L2*n*

LA2Y: L2*c*, L2*e*, L2*g*, L2*i*, L2*k*, L2*m*

LB2Y: L2*a* to L2*n*

In such a manner, each conductor pattern is arranged such that the second linear conductors LA2X, LA2Y are located between the first linear conductor LA1X and the first linear conductor LA1Y in the first region Z1, and the first linear conductors LB1X, LB1Y are located between the second linear conductor LB2X and the second linear conductor LB2Y in the second region Z2. As thus described, with the first linear conductor and the second linear conductor being not superimposed in the layer direction, the line capacitance between the first linear conductor and the second linear conductor is small. Hence it is possible to bring about magnetic field coupling between the primary coil and the secondary coil with a high coupling degree without increasing capacitive coupling between the primary coil and the secondary coil while increasing an external diameter (external form) dimension of the spirally pattern to the maximum. Therefore, with respect to the normal mode signal, the magnetic fields of the primary coil and the secondary coil cancel each other, such that an inductance component of the common mode noise coil becomes small, and the impedance becomes small. As a result, both the inductance and the capacitance are small, and hence an insertion loss of the normal mode signal is small.

It is to be noted that, since thicknesses of the layer (4), the layer (6) the layer (8), the layer (10) and the layer (12) are made larger (e.g., about 50 μm) than the other layers (e.g., about 25 μm) as represented in FIGS. 5 and 6, an interlayer distance between each linear conductor is effectively large, and the capacitance between the linear conductors is small. For example, respective interlayer distances between the first linear conductors L1*b* and L1*d*, between L1*d* and L1*f*, between L1*f* and L1*h*, between L1*h* and L1*j*, between L1*j* and L1*l*, between L1*c* and L1*e*, between L1*e* and L1*g*, between L1*g* and L1*i*, between L1*i* and L1*k*, and between L1*k* and L1*m* are large. The same also applies to the second linear conductors. It is to be noted that among the plurality of layers formed with the linear conductors, the thicknesses of the layer (2) and the layer (14) are not made large. These layers have a small influence on an increase in capacitance between the linear conductors since the adjacent linear conductors which are adjacent in a thickness direction are only on one side.

When the base material layer is a dielectric ceramic (low temperature co-fired ceramic material mainly composed of $BaO—Al_2O_3—SiO_2$[BAS]) with a relative permittivity ∈r of 6 to 10, it is effective to make the interlayer distance large so as to make the capacitance between the linear conductors small. When the base material layer is a material with a small relative permittivity (e.g., polyimide or liquid crystal polymer with ∈r of the order of 3 to 5), thicknesses of the base material layers may be made uniform.

As is made clear by comparing FIG. 5 and FIG. 6, in the layers except for the layers (1) and (14) (the layers except for lead-out wiring layers), the primary coil and the secondary coil on the cross section A1-A2 are reversed compared to those on the cross section B1-B2. That is, each linear conductor constituting the primary coil and each linear conductor constituting the secondary coil are 180-degree rotational symmetrical with respect to a coil axis passing through a center of FIG. 4. When seen in a plan shape, they are point-symmetrical with respect to the center o of FIG. 4.

Figure 7:
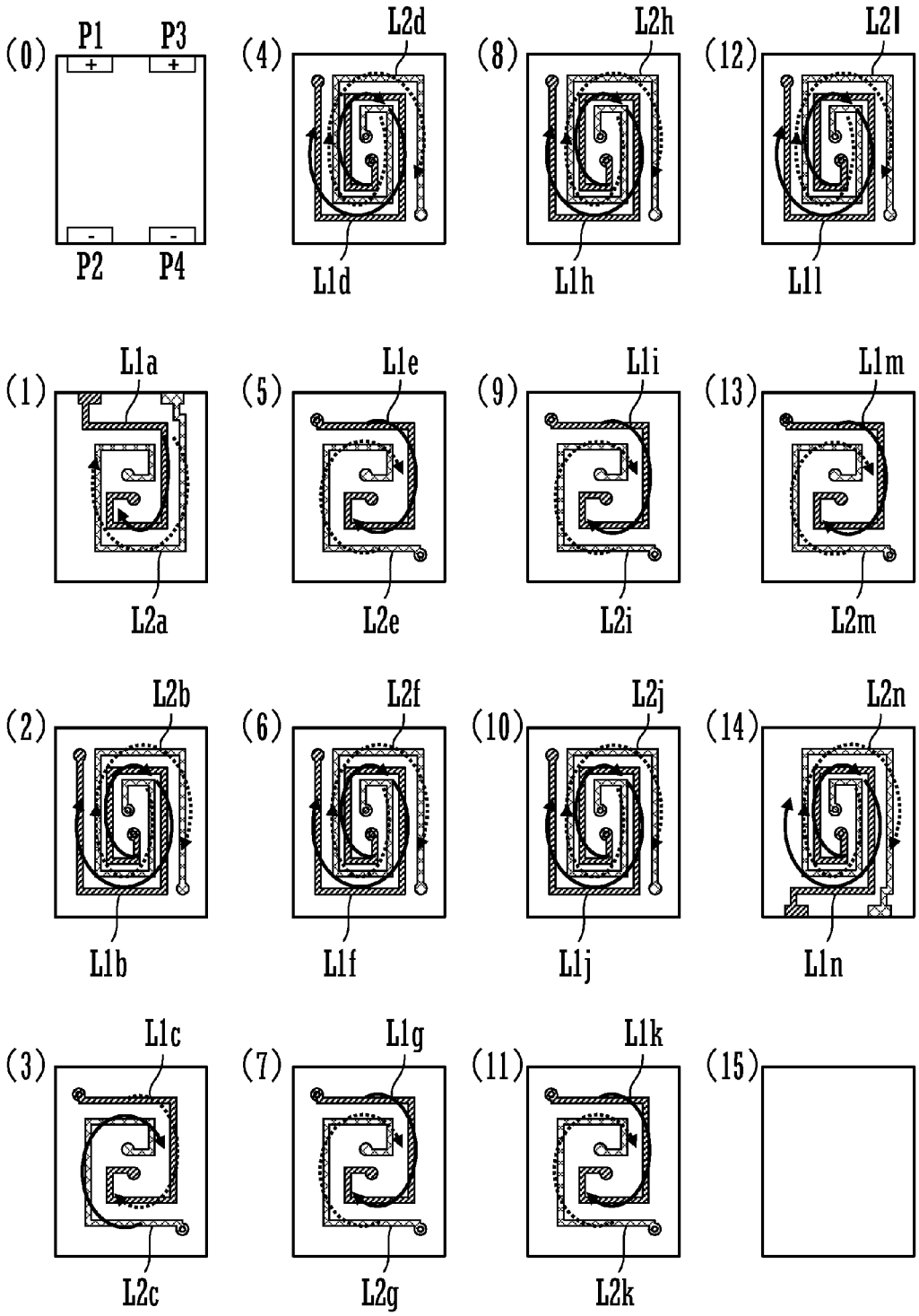
FIG. 7 is a view showing a direction of a common mode current when the current flows.
Figure 8:
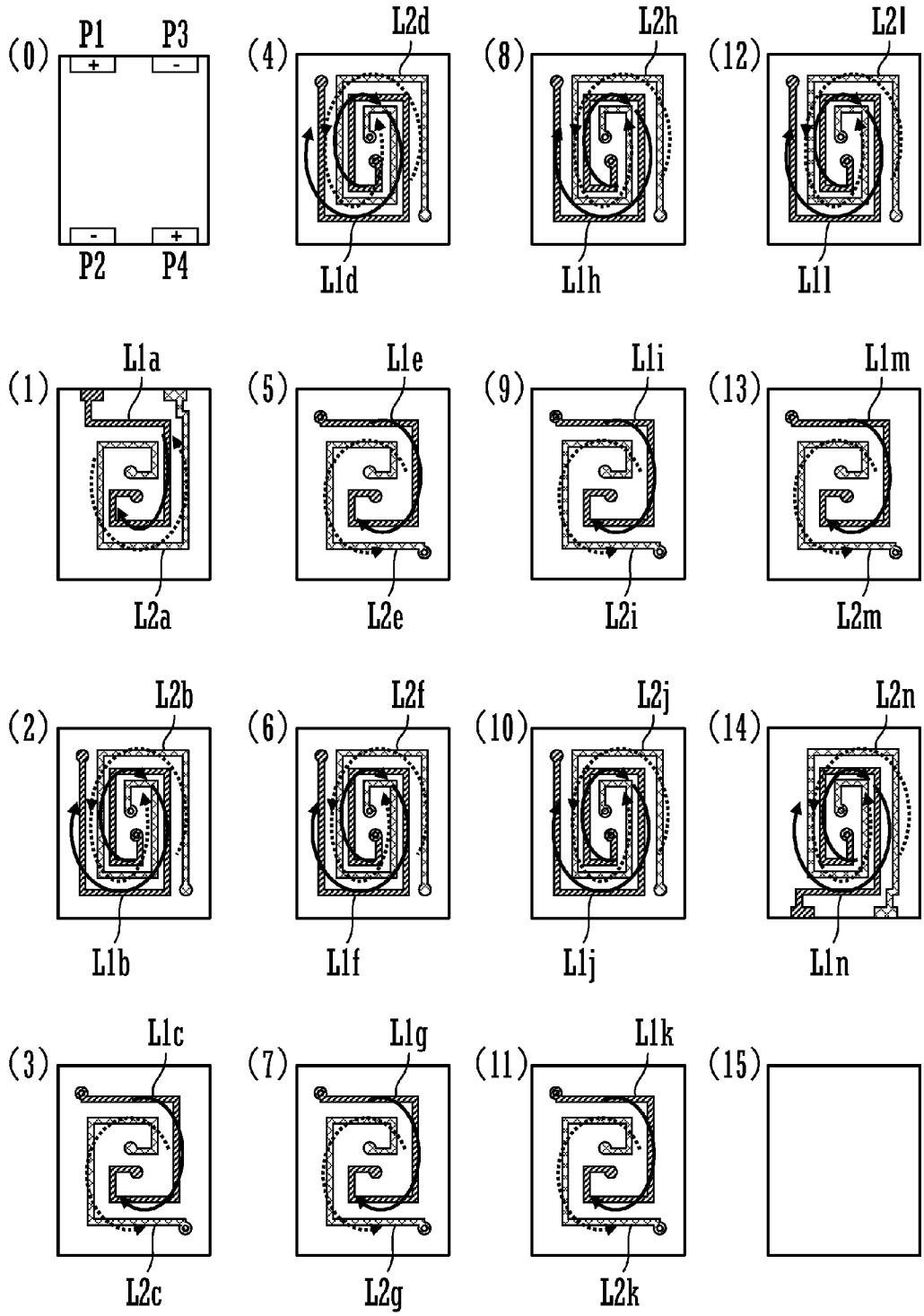
FIG. 8 is a view showing a direction of a normal mode current when the current flows.

FIG. 7 is a view showing a direction of the common mode current when the current flows. FIG. 8 is a view showing a direction of the normal mode current when the current flows. In these diagrams, a solid-line arrow indicates a direction of the current flowing in the primary coil, and a broken line indicates a direction of the current flowing in the secondary coil. As shown in FIG. 7, when the common mode current flows, a magnetic flux of the primary coil and a magnetic flux of the secondary coil strengthen each other, and the coils thus define and function as large inductors. For this reason, impedance in seeing the common mode choke coil 101 from the input/output terminals P1, P3 is high, and the common mode current (common mode noise) is significantly reduced or prevented.

As shown in FIG. 8, when the normal mode current flows, the magnetic flux of the primary coil and the magnetic flux of the secondary coil are cancelled, and thus the coils do not substantially function as inductors. Therefore, the normal mode signal is transmitted with a low loss.

According to this preferred embodiment of the present invention, since the primary coil L1 and the secondary coil L2 are strongly coupled to each other without using the magnetic body such as a ferrite for the base material layer, the use of the dielectric body for the base material layer prevents an increase in loss of the normal mode signal especially in the high frequency band.

Further, since the first linear conductors L1*a* to L1*n* and the second linear conductors L2*a* to L2*n* are point-symmetrical or substantially point-symmetrical with respect to the central axes of the primary coil and the secondary coil as seen in a plan view from a laminating direction of the plurality of base material layers, the symmetry of the circuit including a stray capacitance is high each between the input/output terminals P1 and P3 and between the input/output terminals P2 and P4. For this reason, the conversion from the common mode noise to the normal mode signal (noise) is significantly reduced or prevented.

Figure 9:
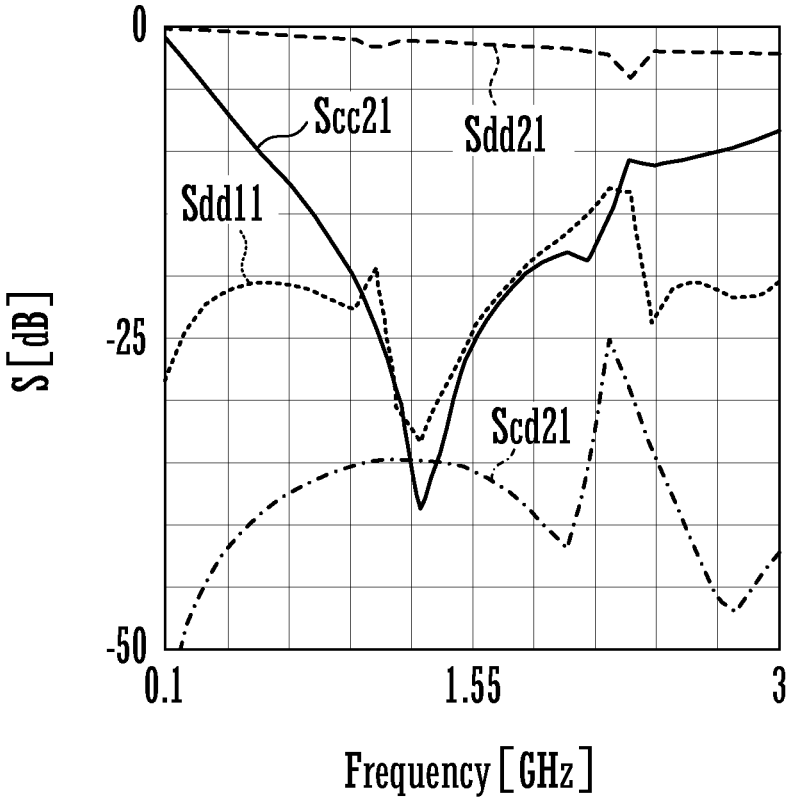
FIG. 9 is a diagram showing frequency characteristics of the common mode choke coil 101.

FIG. 9 is a diagram showing frequency characteristics obtained by actual measurement of an example of the common mode choke coil 101 when a plane size of the laminated body is set to 1.25 mm×1.0 mm, a thickness thereof to 0.7 mm, a gap between each layer to 25 μm and 50 μm, a line width of the linear conductor to 40 μm and a distance between each line to 40 μm, for example. Here, meanings of respective characteristic curves are as follows:

| | |
|---|---|
| Sdd11 | Return loss of normal mode |
| Sdd21 | Insertion loss of normal mode |
| Scc21 | Insertion loss of common mode |
| Scd21 | Insertion loss of conversion component from common mode to normal mode |

As is clear from Sdd11 (the return loss of the normal mode signal) of FIG. 9, a low reflection characteristic has been obtained as to the normal mode signal in a broad band. Further, as is clear from Scc21 (the Insertion loss of the common mode noise), a large attenuation characteristic has been obtained as to the common mode signal at a frequency of not lower than several 100 MHz. An electrode has been made in this characteristic in the vicinity of 1.3 GHz because of self-resonance of inductance generated in the common mode. Further, as is clear from Scd21 (an amount of insertion loss of the conversion component from the common mode to the normal mode), the noise is not higher than about −25 dB in all the frequency bands, and has been sufficiently reduced or prevented. It is to be noted that a notch has been made in Sdd21 in the vicinity of 2.27 GHz, and this is a resonance point generated due to a difference in inductance (difference in line length) between the primary coil L1 and the secondary coil L2. When this resonance frequency is set as appropriate, it is possible to provide a filter function of attenuating the normal signal of a predetermined frequency. In that case, for example, a balanced low-pass filter need not be separately provided other than the common mode choke coil, and hence the number of components is reduced and cost is lowered.

According to this preferred embodiment of the present invention, since the first linear conductor and the second linear conductor are not adjacent or substantially adjacent in the laminating direction, the stray capacitance generated between the primary coil L1 and the secondary coil L2 is small. That is, even when the interlayer distance between the first linear conductor constituting the primary coil and the second linear conductor constituting the secondary coil is made small in order to enhance the magnetic field coupling between the primary coil L1 and the secondary coil L2, the stray capacitance generated between the primary coil L1 and the secondary coil L2 is small. Hence the differential impedance of the common mode choke coil is properly ensured, so as to be matched with the impedance of the parallel lines. Particularly, as seen in a plan view from a direction of winding axes of the primary coil and the secondary coil, the second linear conductors in the first region are not superimposed on each other, and the first linear conductors in the second region are not superimposed on each other, such that the stray capacitance becomes further smaller, and the differential impedance of the common mode choke coil is ensured more properly, and is further easily matched with the impedance of the balanced transmission line.

Moreover, according to this preferred embodiment of the present invention, the capacitance between the first linear conductor and the capacitance between the second linear conductor are both small. Hence, the self-resonance frequency (cutoff frequency) by the line capacitances and the inductances of the primary coil and the secondary coil are shifted to the high frequency side, resulting in excellent insertion loss characteristic being ensured in the broad frequency band.

According to the first preferred embodiment, since the capacitance generated between the ground conductor located on a printed wiring board of a mounted member and the first linear conductors L1*a* to L1*n* is almost equal to the capacitance generated between the ground conductor and the second linear conductors L2*a* to L2*n*, and hence the symmetry between the primary coil and the secondary coil is ensured. That is, values of the capacitors C11, C12, C21, C22 shown in FIG. 2B have relations of C11≅C12 and C21≅C22. For this reason, there occurs almost no conversion from the common mode noise to the normal mode signal (noise) due to the unbalance of the capacitance.

Second Preferred Embodiment

Figure 10:
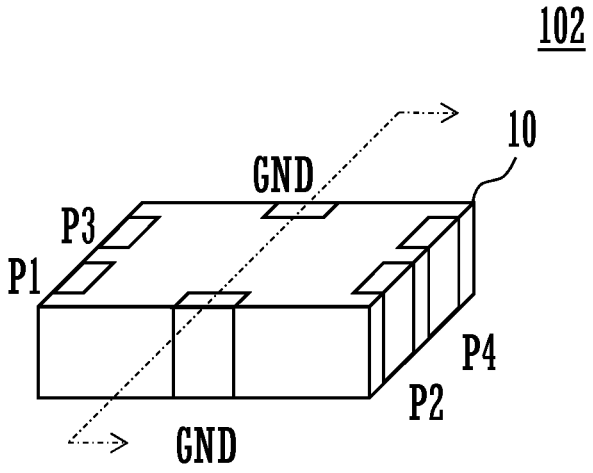
FIG. 10 is an external perspective view of a common mode choke coil 102 of a second preferred embodiment of the present invention.
Figure 11A:
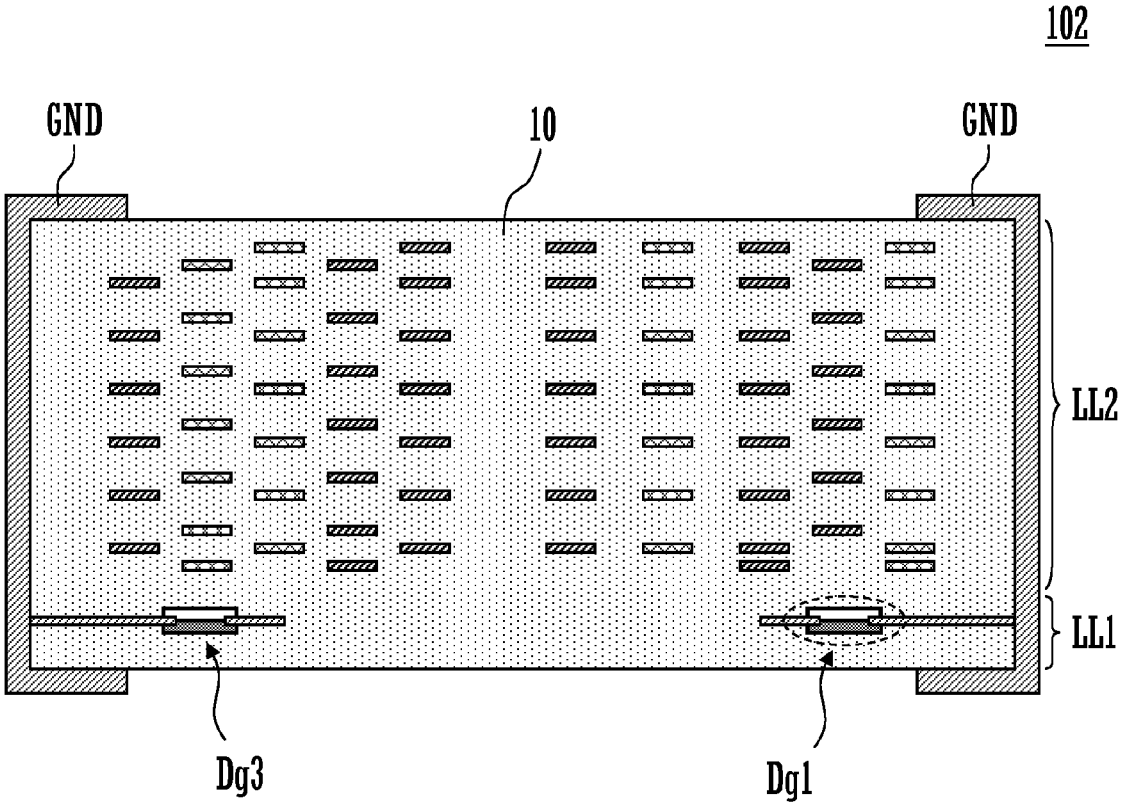
FIG. 11A is a sectional view of the common mode choke coil 102.

In the second preferred embodiment of the present invention, a common mode choke coil including an ESD protective element is shown. FIG. 10 is an external perspective view of a common mode choke coil 102 of the second preferred embodiment. FIG. 11A is a sectional view of the common mode choke coil 102, and FIG. 11B is a sectional view of an ESD (Electrostatic Discharge) protective element section.

In this common mode choke coil 102, a similar conductor pattern to that of the common mode choke coil shown in the first preferred embodiment is provided in a lamination section LL2 in FIG. 11A. Then, ESD protective elements Dg1, Dg3 are provided in a lamination section LL1.

Figure 11B:
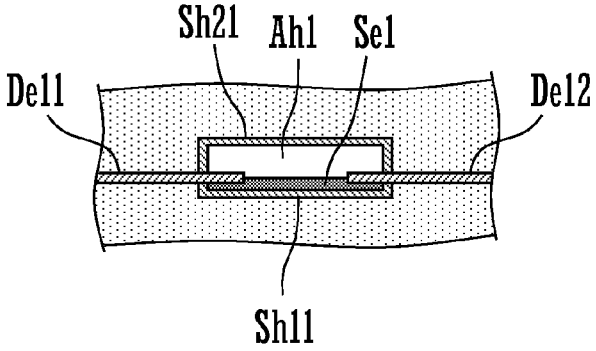
FIG. 11B is a sectional view of an ESD protective element section.

FIG. 11B is a sectional view of the ESD protective element Dg1 portion. In this example, a shield layer Sh11, a discharge auxiliary electrode Se1, discharge electrodes De11, De12, a hollow portion Ah1 and a shield layer Sh21 are provided.

Figure 12:
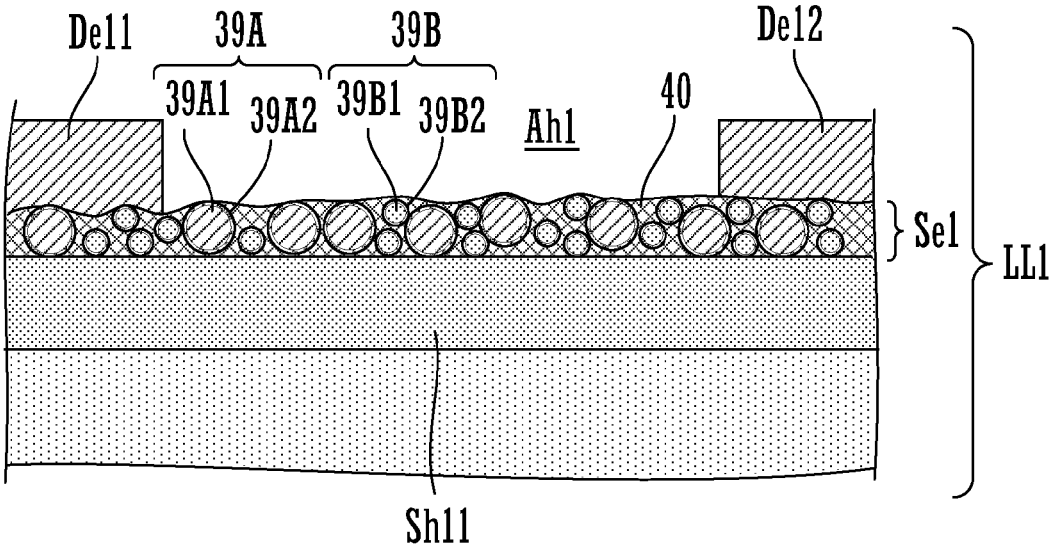
FIG. 12 is a schematic diagram representing a cross-sectional structure of a portion including discharge electrodes De11, De12.

FIG. 12 is a schematic diagram representing a cross-sectional structure of a portion including discharge electrodes De11, De12. The shield layer Sh11 is an insulating ceramic layer, and is provided to prevent a glass component from exuding from a substrate to the discharge auxiliary electrode Se1 portion at the time of integral firing of an LTCC green sheet to serve as the substrate.

The discharge auxiliary electrode Se1 includes discharge auxiliary members 39A, 39B. The discharge auxiliary member 39A is provided with a granular metal material 39A1 and an insulating coated film 39A2 provided on the surface of this metal material 39A1. Further, the discharge auxiliary electrode Se1 is provided with a granular semiconductor material 39B1 and an insulating coated film 39B2 provided on the surface of this semiconductor material 39B1. Here, the metal material 39A1 is Cu particles, and the semiconductor material 39B1 is SiC particles. Further, the insulating coated film 39A2 is an alumina coated film, and the insulating coated film 39B2 is an $SiO_2$ coated film formed by oxidizing the semiconductor material 39B1.

Moreover, a glass-like material 40 is arranged in the discharge auxiliary electrode Se1 so as to surround the discharge auxiliary members 39A, 39B. The glass-like material 40 is not one formed intentionally, but one formed through a reaction such as oxidation of a constitutional material or the like derived from a peripheral section of a sacrifice layer to be used for forming the hollow Ah1.

With the structure shown in FIG. 12, when a high voltage is applied to between the discharge electrodes De11 and De12, there occur: (1) a creeping discharge of the discharge auxiliary electrode Se1; (2) an air discharge between the discharge electrodes De11 and De12; and (3) a discharge to convey the discharge auxiliary members 39A, 39B like stepping stones. Static electricity is discharged by these discharges.

The common mode choke coil 102 shown in FIGS. 10 and 11 is preferably manufactured using materials and a process as described below.

For the shield layers Sh11, Sh21 of the lamination section LL1 portion, alumina paste mainly composed of an alumina powder is preferably used, for example. Further, electrode paste for forming the discharge electrode is preferably obtained by adding a solvent to a binder resin made of a Cu powder, ethyl cellulose or the like, followed by stirring and mixing.

Resin paste to serve as a starting point of forming the hollow Ah1 is also prepared by a similar method. This resin paste is made up only of a resin and a solvent. As a resin material, there is used a resin that is decomposed and dissipated at the time of firing. For example, it is a polyethylene-telephthalate (PET) resin, a polypropylene resin, an acryl resin, or the like.

Mixed paste for forming the discharge auxiliary electrode Se1 is obtained by preparing a Cu powder as a conductive material and a BAS powder as a ceramic material at a predetermined proportion and adding the binder resin and the solvent thereto, followed by stirring and mixing.

The paste for the shield layer Sh11 is applied to a green sheet as a base, followed by application of electrode paste for the discharge electrode, application of resin paste for forming the hollow Ah1, and further application of paste for the shield layer Sh21.

The lamination section LL2 shown in FIG. 11 is configured by laminating the ceramic green sheets and crimping them in a similar manner to a normal ceramic multilayered substrate.

The laminated body formed by joining and crimping is cut out with a micro cutter in a similar manner to a chip-type electronic component such as an LC filter, to be separated into respective element bodies. Thereafter, the end surfaces of the respective element bodies are applied with the electrode paste to be a variety of external terminals after firing.

Subsequently, it is fired in an $N_2$ atmosphere in a similar manner to the normal ceramic multilayered substrate. Further, in the case of introducing a noble gas such as Ar or Ne into the hollow section so as to lower a response voltage to the ESD, firing may be performed in an atmosphere of the noble gas such as Ar or Ne in a temperature region for performing shrinkage and firing of the ceramic material. When the discharge electrodes De11, De12 and the external electrode are made of electrode materials that are not oxidized, firing may be performed in an air atmosphere.

An Ni—Sn plated film is then formed on the surface of the external electrode by electrolytic Ni—Sn plating in a similar manner to the chip-type electronic component such as the LC filter.

Incidentally, since it is generally extremely difficult to perform firing while bringing Fe in ferrite into an oxidized state without bringing Cu as the electrode material into an oxidized state, in the case of using ferrite for the laminated element body, it is desirable to use Ag as the electrode material. However, when the discharge electrodes De11, De12 are formed of Ag, migration significantly appears, to cause a change in spark gap with the passage of time. As opposed to this, according to this preferred embodiment of the present invention, the use of the LTCC for the laminated element body allows the use of Cu as the electrode material. When the discharge electrodes De11, De12 are formed of Cu, an oxidized film of the electrode surface Cu is formed by energy at the time of discharge, but this film does not function as the discharge electrode member, and hence a discharge gap is held uniform or substantially uniform even when the discharge is repeated.

Figure 13:
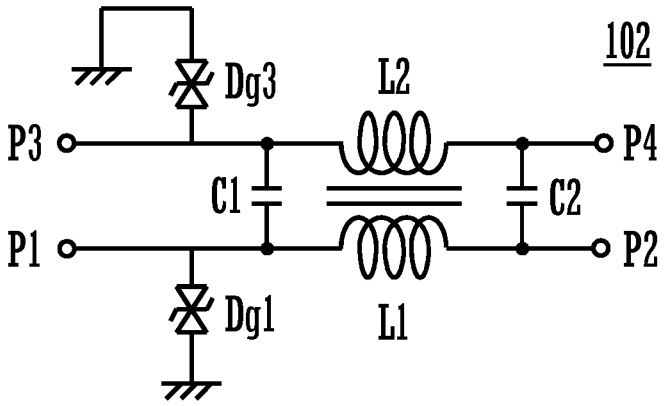
FIG. 13 is an equivalent circuit diagram of the common mode choke coil 102 according to the second preferred embodiment of the present invention.

FIG. 13 is an equivalent circuit diagram of the common mode choke coil 102. With the configuration as described above, the primary coil L1 with the first end being the input/output terminal P1 and the second end being the input/output terminal P2 is configured, and the secondary coil L2 with the first end being the input/output terminal P3 and the second end being the input/output terminal P4 is configured.

A feeder circuit, for example, is connected to between the input/output terminal P1 and the input/output terminal P3. A digital signal processing circuit, for example, is connected to between the input/output terminal P2 and the input/output terminal P4. The capacitors C1, C2 in FIG. 13 are ones equivalently representing a stray capacitance between the primary coil L1 and the secondary coil L2.

When static electricity exceeding a voltage to be protected is applied to the input/output terminal P1, a discharge element Dg1 formed of the discharge electrode and the discharge auxiliary electrode is discharged (conducted), and the impedance becomes low. Therefore, the static electricity applied to the input/output terminal P1 is shunted to the ground via the discharge element Dg1. Similarly, when static electricity exceeding a voltage to be protected is applied to the input/output terminal P3, a discharge element Dg3 is conducted, and the impedance becomes low. Therefore, the static electricity applied to the input/output terminal P3 is shunted to the ground via the discharge element Dg3.

As shown in FIG. 13, the discharge elements Dg1, Dg3 are preferably provided on the side where the static electricity enters. Particularly, even when the input impedance of the circuit connected to the input/output terminals P2, P4 is low, the common mode choke coil formed of the primary coil L1 and the secondary coil L2 has high impedance with respect to a surge of the high frequency component such as the ESD, such that the surge is reflected on the common mode choke coil, and the discharge elements Dg1, Dg3 are each applied with a high voltage and rapidly reach a discharge voltage, to start discharging. This reliably prevents the surge from flowing into the circuit connected to the input/output terminals P2, P4.

In such a manner, in the common mode choke coil 102 of the second preferred embodiment, it is possible to easily adopt (integrally configure) the ESD protective element on the surface or in the inner layer of the laminated element body due to the base material layer being the non-magnetic body layer.

In addition, a non-linear resistance element such a varistor can also be used as the ESD protective element, but the ESD protective element using such a voltage variable resistance system does not have very good responsiveness, and hence, when it is previously arranged on a stage prior to the primary coil and the secondary coil, this element itself may be broken due to a rush current. Accordingly, as the ESD protective element, it is preferable to configure an ESD protective element of a so-called inter-electrode discharge system (spark gap system) which includes a hollow section inside the laminated element body and a pair of discharge electrodes provided in the hollow section.

It is to be noted that, although two ground terminals preferably are provided in the example shown in FIGS. 10 and 11, one common ground terminal may be provided. Further, the ESD protective element may be provided only between the input/output terminal P2 and the ground or only between the input/output terminal P4 and the ground, depending on the purpose.

It should be noted that in each of the preferred embodiments shown above, the number of turns of the coil and the number of crossings of the primary coil and the secondary coil, which are shown in the constitutional views of the laminated body, are naturally illustrative, and the number of turns of each linear conductor and the number of crossings thereof are not restricted to those shown in these diagrams. They may be set in accordance with desired characteristics. The number of turns of each of the primary coil and the secondary coil contributes to setting of impedance in the normal mode. Further, the number of crossings of the primary coil and the secondary coil contributes to the coupling degree between the primary coil and the secondary coil.

Especially when the number of turns of the linear conductor per layer is not smaller than one, variations in inductance and coupling degree due to displacement of lamination of the base material layers become small. Further, when the number of turns of the linear conductor per layer is not smaller than three, an interlayer capacitance between the first linear conductor and the second linear conductor which are adjacent between the layers tends to increase. Therefore, the number of turns of the linear conductor per layer is preferably not smaller than one and not larger than three.

In the above preferred embodiments, the examples have been shown where the main sections of the first and second linear conductors preferably are extended in a surface direction of the base material layer, but the first and second linear conductors may be arranged such that the main sections of the first and second linear conductors are extended in the laminating direction of the base material layer. That is, the first and second linear conductors may be arranged such that the winding axes of the primary coil and the secondary coil are oriented in the surface direction of the base material layer.

Third Preferred Embodiment

Figure 14:
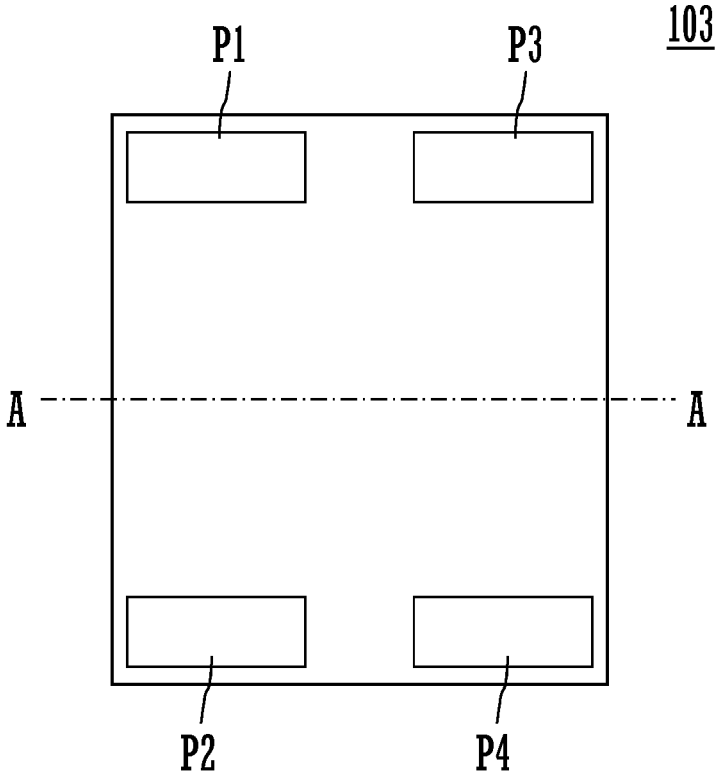
FIG. 14 is a plan view of a common mode choke coil 103 according to a third preferred embodiment of the present invention.

FIG. 14 is a plan view of a common mode choke coil 103 according to a third preferred embodiment of the present invention. The input/output terminals p1, p2, p3, p4 are provided on the surface of the common mode choke coil 103.

Figure 15:
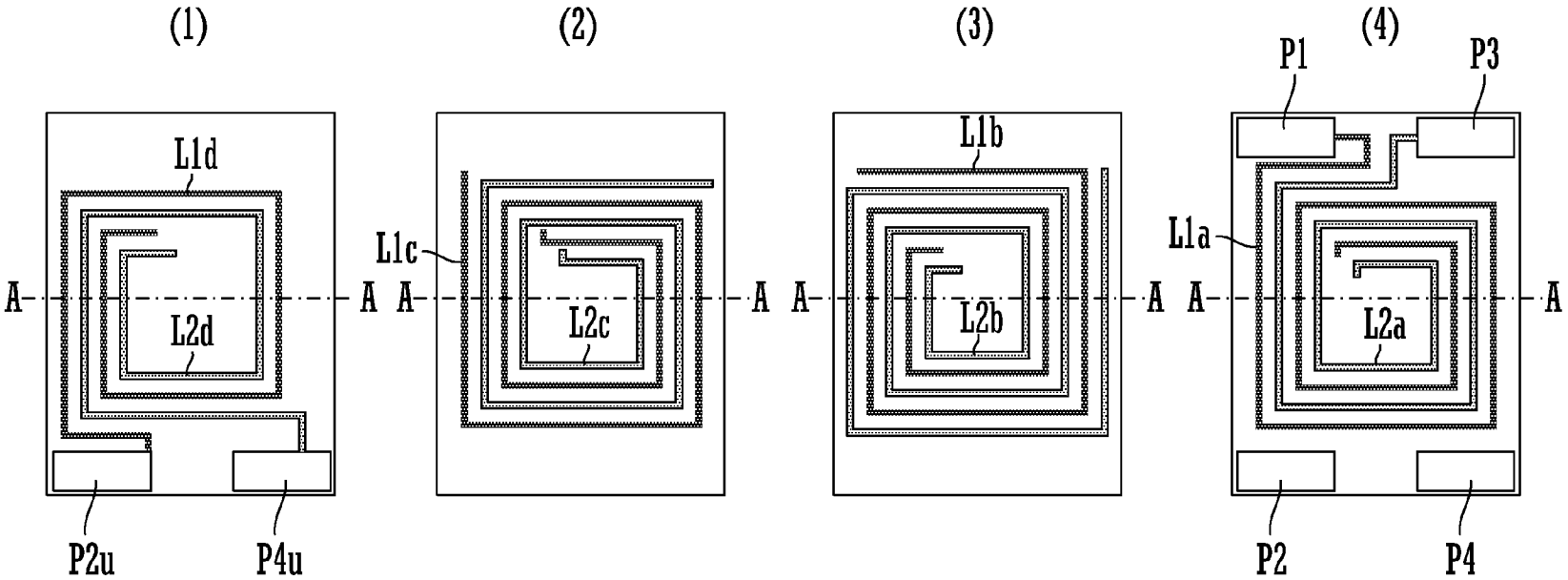
FIG. 15 is an exploded plan view showing a conductor pattern and the like of each layer in the common mode choke coil of the third preferred embodiment of the present invention.

FIG. 15 is an exploded plan view showing a conductor pattern and the like of each base material layer in the common mode choke coil of the third preferred embodiment. (1) is a plan view of a first layer (bottom layer), (2) is a plan view of a second layer, (3) is a plan view of a third layer, and (4) is a plan view of a top layer.

Figure 16:
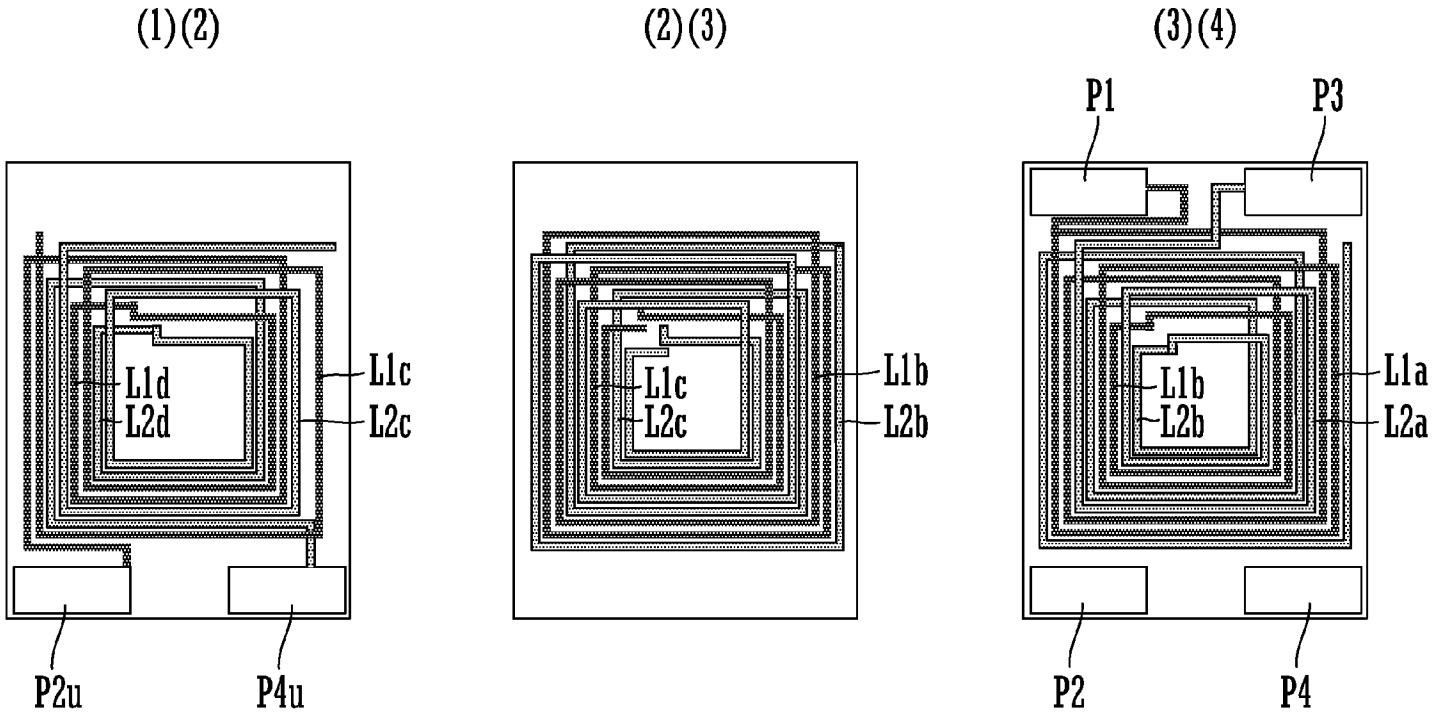
FIG. 16 is a plan view representing, as superimposing, conduction patterns for two layers of the common mode choke coil of the third preferred embodiment of the present invention.

FIG. 16 is a view showing the connection relation of each conductor as to a pair of two layers which are adjacent in the layer direction out of the above four layers.

Figure 17:
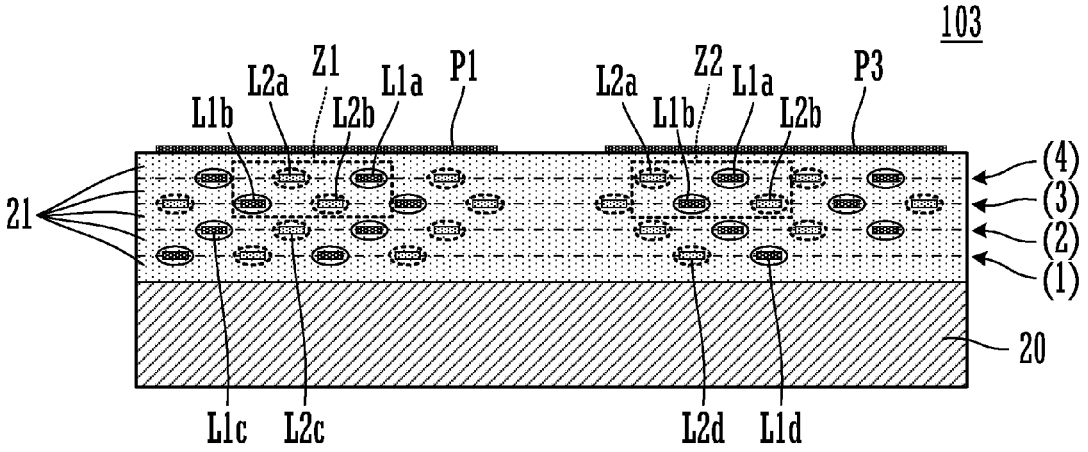
FIG. 17 is a sectional view along a line A-A in FIGS. 14 and 15.
Figure 18:
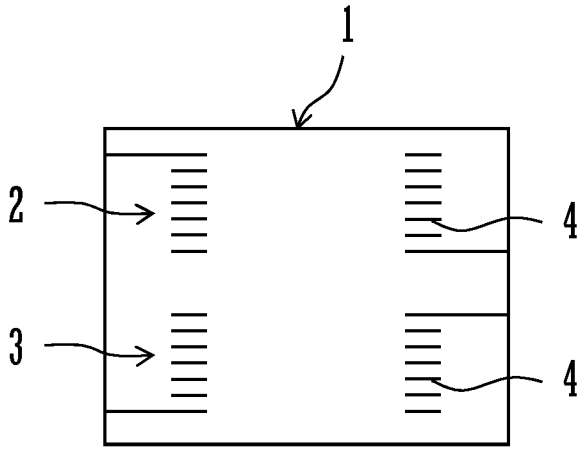
FIG.18 PRIOR ART
FIG. 18 is a sectional view of a common mode choke coil shown in Unexamined Japanese Patent Publication No. 2003-068528.

FIG. 17 is a sectional view along a line A-A in FIGS. 14 and 15. As represented in FIG. 17, the common mode choke coil 103 is provided with a substrate 20, and a plurality of linear conductors laminated on this substrate 20 via an interlayer insulating film 21.

As shown in FIGS. 15 and 17, a first linear conductor L1*d*, a second linear conductor L2*d* and terminal electrodes P2*u*, P4*u* are provided on the bottom layer (1). The first end of the first linear conductor L1*d* is connected to the terminal electrode P2*u*, and the first end of the second linear conductor L2*d* is connected to the terminal electrode P4*u*.

The first linear conductor L1*c* and the second linear conductor L2*c* are provided on the second layer (2). The first linear conductor L1*b* and the second linear conductor L2*b* are provided on the third layer (3). Then, the first linear conductor L1*a*, the second linear conductor L2*a* and the input/output terminals p1, p2, p3, p4 are provided on the top layer (4). The first end of the first linear conductor L1*a* is connected to the input/output terminal P1, and the first end of the second linear conductor L2*a* is connected to the input/output terminal P3. The input/output terminals P2, P4 and the terminal electrodes P2*u*, P4*u* on the bottom layer (1) are respectively connected via the interlayer connection conductors.

The second ends of the conductors L1*d*, L2*d* on the bottom layer (1) are respectively connected to the second ends of the conductors L1*c*, L2*c* on the second layer (2) via the interlayer connection conductors. The first ends of the conductors L1*c*, L2*c* on the second layer (2) are respectively connected to the first ends of the conductors L1*b*, L2*b* on the third layer (3) via the interlayer connection conductors. Similarly, the second ends of the conductors L1*b*, L2*b* on the third layer (3) are respectively connected to the second ends of the conductors L1*a*, L2*a* on the top layer (4) via the interlayer connection conductors.

As is clear from FIGS. 15 and 16, the primary coil includes the first linear conductors L1*a*, L1*b*, L1*c*, L1*d*, and the secondary coil includes the second linear conductors L2*a*, L2*b*, L2*c*, L2*d*. Further, the primary coil (L1*a*, L1*b*, L1*c*, L1*d*) is provided between the input/output terminals P1 and P2, and the secondary coil (L2*a*, L2*b*, L2*c*, L2*d*) is provided between the input/output terminals P3 and P4.

In FIG. 17, the first linear conductors L1*a*, L1*b*, L1*c*, L1*d* constituting the primary coil are each surrounded by an ellipse of a solid line. Further, the second linear conductors L2*a*, L2*b*, L2*c*, L2*d* constituting the secondary coil are each surrounded by an ellipse of a broken line. Here, when the first region Z1 surrounded by a rectangle of a broken line is seen in a plan view, these conductor patterns are arranged such that the second linear conductors L2*a*, L2*b* are located between the first linear conductors L1*a* and L1*b* in the first region Z1. Further, when the second region Z2 surrounded by a rectangle of a broken line is seen in the plan view, these conductor patterns are arranged such that the first linear conductors L1*a*, L1*b* are located between the second linear conductors L2*a* and L2*b* in the second region Z2.

Although the first region Z1 and the second region Z2 of the minimum portion have been illustrated in FIG. 17, the first region Z1 and the second region Z2 exist in a similar manner in other portions as to two layers which are adjacent in the layer direction.

A common mode choke coil according to various preferred embodiments of the present invention can be used for high-speed interfaces such as a USB or the HDMI, for example. Further, a common mode choke coil according to various preferred embodiments of the present invention is also useful as a filter for a power supply circuit with a high switching frequency (e.g., not lower than 1 MHz), a BUS line at a high speed (e.g., transfer rate of 600 Mbit/sec), and the like. Moreover, it is also applicable to a high-speed interface in GHz bands of 3 GHz, 5 GHz, 7.5 GHz and the like.

While preferred embodiments of the present invention have been described above, it is to be understood that variations and modifications will be apparent to those skilled in the art without departing from the scope and spirit of the present invention. The scope of the present invention, therefore, is to be determined solely by the following claims.

What is claimed is:

1. A common mode choke coil comprising:

a laminated body including a plurality of base material layers laminated on each other;

a plurality of first linear conductors respectively provided on surfaces of the plurality of base material layers;

a plurality of second linear conductors respectively provided on the surfaces of the plurality of base material layers;

a primary coil including the plurality of first linear conductors that are spirally wound and connected;

a secondary coil including the plurality of second linear conductors that are spirally wound and connected and magnetically coupled to the primary coil;

a first region in which the plurality of second linear conductors adjacent to each other are located between the first linear conductors as seen in a plan view from a direction of winding axes of the primary coil and the secondary coil; and a second region in which the plurality of first linear conductors adjacent to each other are located between the second linear conductors as seen in the plan view from the direction of winding axes of the primary coil and the secondary coil; wherein the first linear conductor and the second linear conductor are not superimposed as seen in the plan view from the direction of the winding axes of the primary coil and the secondary coil in the first region and the second region.

2. The common mode choke coil according to claim 1, wherein:

the primary coil further includes an interlayer conductor that connects the plurality of first linear conductors between the layers; and the secondary coil further includes an interlayer conductor that connects the plurality of second linear conductors between the layers.

3. The common mode choke coil according to claim 2, wherein the first linear conductors and the second linear conductors are point-symmetrical or substantially point-symmetrical with respect to central axes of the primary coil and the secondary coil as seen in a plan view from a laminating direction of the plurality of base material layers.

4. The common mode choke coil according to claim 2, wherein the plurality of base material layers are non-magnetic body layers.

5. The common mode choke coil according to claim 4, wherein the laminated body includes a first ESD protective element connected to the primary coil and a second ESD protective element connected to the secondary coil, on a surface or in an inner layer of the laminated body.

6. The common mode choke coil according to claim 5, wherein the first ESD protective element and the second ESD protective element each include a hollow section inside the laminated body, and a pair of discharge electrodes provided in the hollow section.

7. The common mode choke coil according to claim 1, wherein the primary coil and the secondary coil are configured such that magnetic fields of the primary coil and the secondary coil cancel each other out with regard to a normal mode signal.

8. The common mode choke coil according to claim 1, wherein at least some of the plurality of base material layers have different thicknesses.

9. The common mode choke coil according to claim 5, wherein at least one of the first ESD protective element and the second ESD protective element includes shield layers, a discharge auxiliary electrode, discharge electrodes, and a hollow portion.

10. A high-speed interface comprising the common mode choke coil according to claim 1.

11. A filter for a power supply circuit comprising the common mode choke coil according to claim 1.

12. A high speed bus line comprising the common mode choke coil according to claim 1.

* * * * *